US006764068B1

(12) United States Patent
Anderson et al.

(10) Patent No.: US 6,764,068 B1
(45) Date of Patent: Jul. 20, 2004

(54) DOCUMENT PROCESSING APPARATUS AND METHOD

(75) Inventors: Bradley J. Anderson, Boise, ID (US); William I. Herrmann, Eagle, ID (US); Leonard T. Schroath, Boise, ID (US); Bruce L. Johnson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/456,757

(22) Filed: Jun. 6, 2003

(51) Int. Cl.[7] ..... B65H 29/46

(52) U.S. Cl. ..... 270/30.2; 271/265.01; 324/228; 324/233; 324/239; 324/240

(58) Field of Search ..... 270/30.2; 271/265.01, 271/265.02; 324/228, 233, 239, 240

(56) References Cited

U.S. PATENT DOCUMENTS 3,978,396 A * 8/1976 Inouye ..... 324/337
4,536,709 A * 8/1985 Ishida ..... 324/239
4,868,499 A * 9/1989 Walker ..... 324/239
5,087,027 A 2/1992 Acquaviva
5,646,794 A * 7/1997 Lindsay, Jr. ..... 360/3
6,362,625 B1 * 3/2002 Wiegert ..... 324/329
6,504,364 B1 * 1/2003 Eidenvall et al. ..... 324/239

* cited by examiner

*Primary Examiner*—Eugene H. Eickholt

(57) ABSTRACT

A method of detecting undesired metal objects in a document feed path and a document processing apparatus that includes a feeder for transporting document sheets along a feed path; and a detector for detecting the presence of foreign metal objects in said feed path. The detector comprises a source of alternating electrical energy connected to a conductive transmitter loop for generating a pulsed magnetic field proximate the feed path and a conductive receiver loop that receives reflected magnetic field signals. The reflected magnetic signals induce electrical signals in the receiver loop which are amplified and processed to produce output signals which are sent to a phase shift analyzer which discriminates among output signals produced in the receiver loop by magnetic reflections from metal objects of varying types to provide an output signal when an undesired metal object in the feed path is detected.

24 Claims, 4 Drawing Sheets

DOCUMENT PROCESSING APPARATUS AND METHOD

TECHNICAL FIELD AND BACKGROUND

The present invention relates to the field of document processing apparatus such as printers, copiers, document scanners, facsimile machines and other document processing and handling apparatus and devices and, more particularly, to apparatus and methods of detecting foreign objects such as paper clips, staples and the like which may inadvertently enter the document processing apparatus or its media feed path. The invention will be described with reference to an automatic document feeder (ADF) used in a multi-function document processing apparatus, but the details and concepts disclosed herein are broadly applicable to a much wider variety of equipment.

Optical and mechanical document load sensors have been used to detect (1) the presence (or absence) of a document sheet or other objects to be scanned in a document input or feed tray and (2) the presence (or absence) of the object or document sheet when it reaches a position at or near a scan line from which light directed onto the document sheet is reflected onto a scan module comprised of a plurality of light responsive elements, as is well known in the art. Optical and mechanical load sensors are also used to detect the presence of blank media sheets onto which copies are produced. Electrical output signals produced by optical and mechanical sheet sensors are used to control the feeding of blank media from a feed tray and document sheets, one at a time, from an ADF tray into the document processing apparatus and to control the beginning and ending of scanning.

Various systems have been devised for detecting the presence of paper clips, staples or other metallic objects that may be present in a document feed tray. One system uses an electrical field generator underlying the document tray where staples or clips are most likely to be found. Energization of the detector commences a period of time after the tray is loaded so as to avoid detection and production of signals caused by other metal objects that may be temporarily present when the tray is being loaded such as an operator's ring or wristwatch.

A method and a simple apparatus for sensing the presence of a foreign metal object such as a metal paper clip or staple, and discriminating such objects from other metal objects such as rings and watches which are often present is desired. The apparatus should be capable of producing alarm or feeder control signals for automatically shutting down automatic sheet feeding of either or both of the document and blank media sheets into the document processor and be capable of fulfilling its intended function regardless of whether the sheets are fed by an ADF or manually.

SUMMARY

Disclosed herein is a document processing method and a document processing apparatus that includes a feeder for transporting document sheets along a feed path; and a detector for detecting the presence of foreign metal objects in said feed path. The detector comprises a source of alternating electrical energy connected to a conductive transmitter loop for generating a pulsed magnetic field proximate the feed path and a conductive receiver loop that receives reflected magnetic field signals. The reflected magnetic signals induce electrical signals in the receiver loop which are amplified and processed to produce output signals which are sent to a phase shift analyzer which discriminates among output signals produced in the receiver loop by magnetic reflections from metal objects of varying types to provide an output signal when an undesired metal object in the feed path is detected.

DETAILED DESCRIPTION OF THE PREFERRED EMBODIMENT

Figure 1:
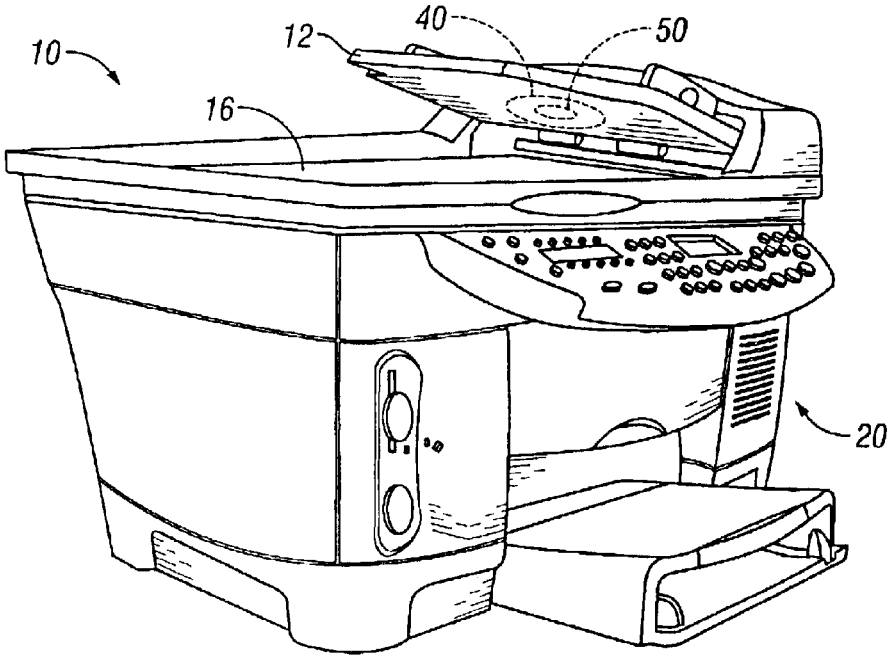
FIG. 1 is a perspective view of an exemplary multi-function document handling device (MFD) and an automatic document feeder (ADF) which may be mounted on top of the MFD.
Figure 5:
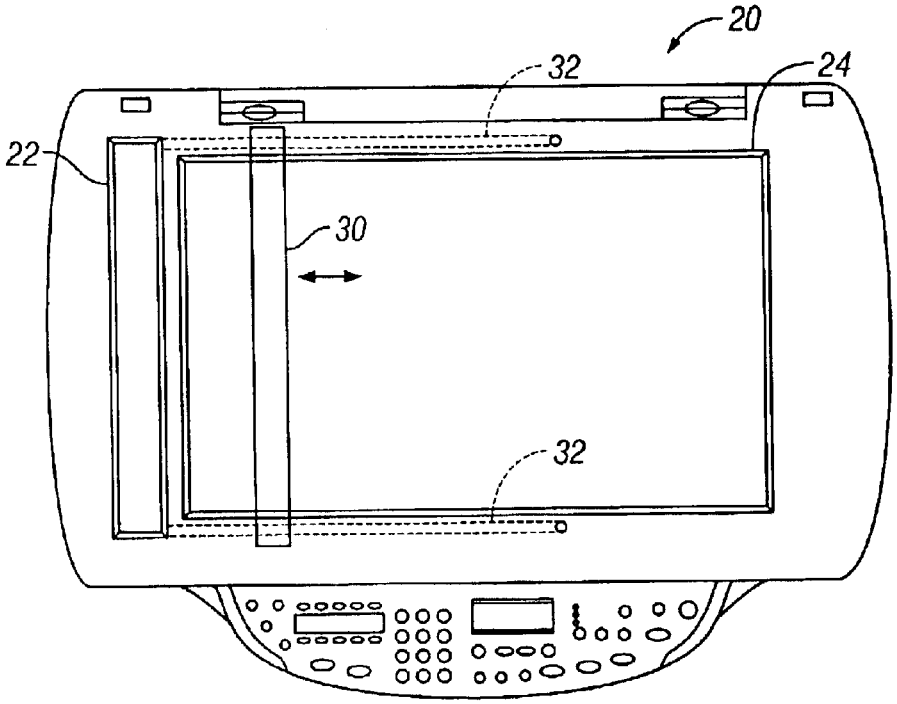
FIG. 5 is a top plan view of the MFD without the ADF.

In the exemplary embodiment of the apparatus shown in the drawings, the upper portion of FIG. 1 depicts an ADF 10 that may be pivotally mounted on top of a MFD 20. The ADF includes a document feed tray 12 on which a stack of document sheets are placed for scanning and a document cover 16. Internally, the ADF includes sheet transport means, not shown or necessary for full understanding of the present disclosure, for feeding individual document sheets to be scanned back and forth across a first clear window 22 in the upper surface of the MFD 20 as seen in FIG. 5. Sheet transport means useful for the ADF are disclosed in U.S. patent applications Ser. Nos. 09/880,338; 09/880339; 09/880340; and 09/880407 all filed Jun. 13, 2001 in the name of Gaarder et al, and all of which are assigned to the assignee of the present invention. The MFD 20 also includes a second clear window 24 in its upper surface for supporting manually placed individual document sheets to be scanned. When scanning individual sheets placed on the second window 24, a moveable scan module 30 of any suitable type, such as an array of charge coupled devices (CCD's) or more expensive contact image sensors, in the MFD is moved on supports 32 such as rods or tracks or past the second window 24 for end to end scanning of the page. The document cover 16 of the ADF 10 preferably has a substantially flat lower surface 14 (FIG. 2) that functions to hold the page to be scanned flat.

When the ADF is used for sequentially feeding and scanning a stack of pages, the moveable scan module in the MFD is parked in a stationary position near the first window 22. The individual pages of the document are sequentially moved by the ADF 10 to bring a portion of the page to be scanned across the window 22 for scanning by the parked scan module. The direction of movement of the page is then reversed by the ADF 10 so that the page can be discharged to a discharge location or tray which may comprise the top surface of the cover 16.

Figure 2:
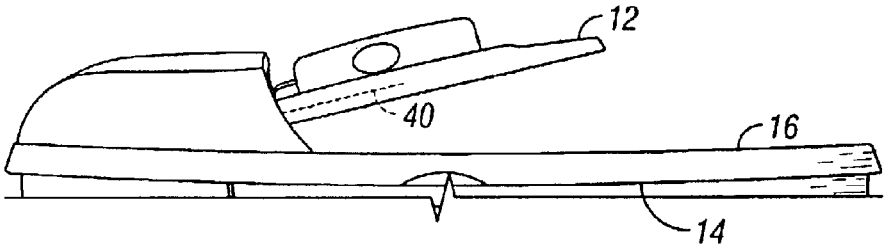
FIG. 2 is a side elevation view of the ADF seen in FIG. 1.
Figure 3:
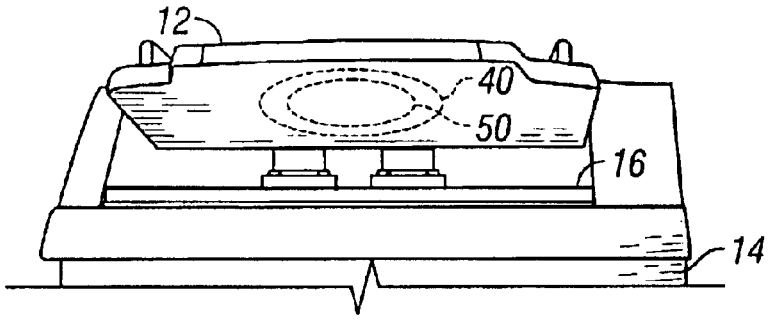
FIG. 3 is a front elevation view of the ADF seen in FIG. 1.
Figure 4:
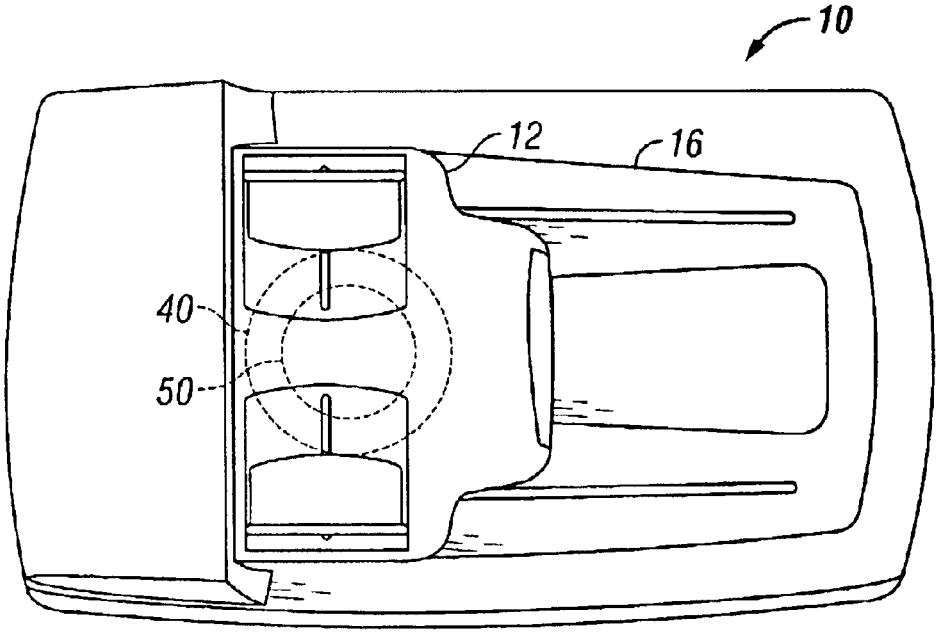
FIG. 4 is a top plan view of the ADF seen in FIG. 1.
Figure 7:
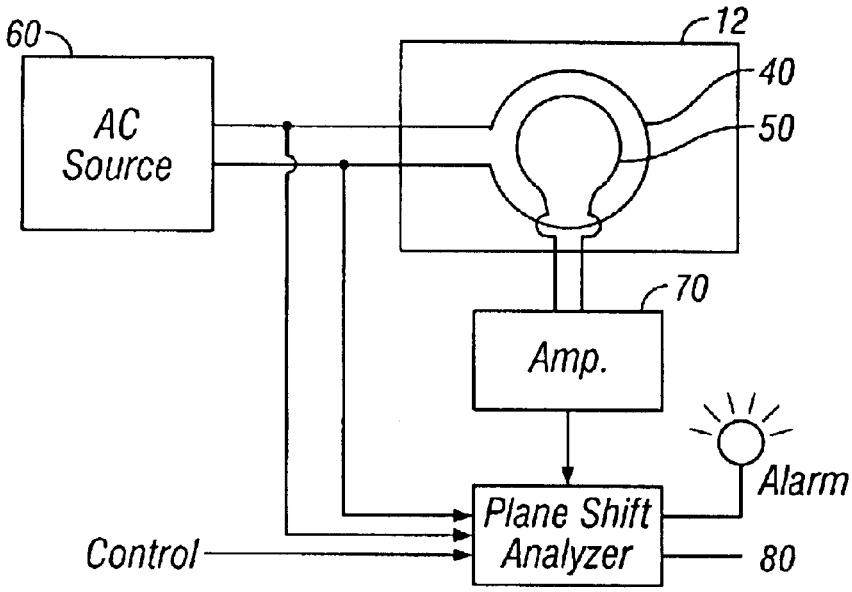
FIG. 7 is a block schematic diagram of an exemplary metal detector.

Shown by the hidden lines in FIGS. 1, 2 and 3 in the bottom of the ADF feeder tray 12 are one or more pairs of transmitter and receiver coils 40, 50, respectively of the metal detector depicted in FIG. 7. Metal detector technology is well developed and known to those skilled in the art. The transmitter and receiver coils 40, 50 preferably are arranged in substantially the same plane and are positioned for detecting the presence of metal objects that may fall into the tray 12. Accordingly, the coils 40, 50 should generally be located near the lower or left end of the tray 12 where foreign metal objects such as staples and paper clips are most likely to collect. The coils 40, 50 may have any desired configuration and need not be circular as depicted, but the two coils of each coil pair are shielded from each other, and are usually maintained at a substantially constant distance apart.

Figure 6:
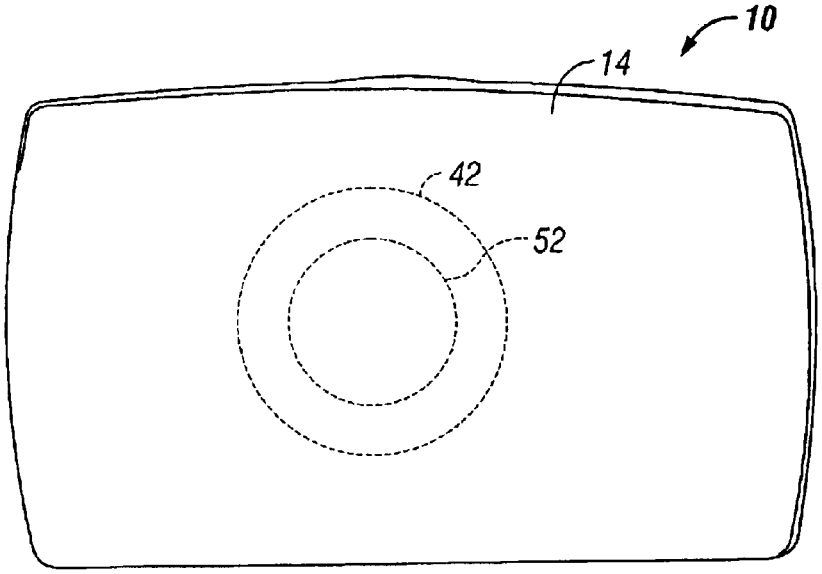
FIG. 6 is a bottom plan view of the ADF.

One or more additional pairs of coils 42, 52 may be positioned in other suitable locations such as in a blank media feed tray and/or in the substantially flat lower surface 14 of the ADF 10 as seen in FIG. 6 for detecting the presence of foreign metal objects which may fall onto and remain on the upper surface and windows 22, 24 of the MFD 20.

Turning now to FIG. 7, the metal detector preferably comprises a very low frequency detector having a transmitter coil 40 electrically connected to a source of AC power 60 for inducing a magnetic field near the transmitter coil 40. Electrical energy induced in the receiver coil 50 by reflection of the magnetic field off of a metal object is amplified by an amplifier 70 and electrically conducted to a phase shift analyzer 80 which produces an output signal useful as an alarm or document feeder stop signal when the phase shift analyzer 80 detects phase shifts in a certain range caused by metal objects of different sizes and types in reflections of the magnetic field induced by the transmitter coil 40. The phase shift analyzer 80 may be adjusted to filter, and thus discriminate between phase shifts caused by metal objects of different types and sizes.

Other metal detectors are well known which may also used as described above. These include pulse induction detectors which may employ a common transmitter/receiver coil and a pulse sampling circuit to monitor the duration of reflected pulses which varies when metal objects are present, and beat frequency oscillator detectors which produce transmitter pulses of offset frequency to generate metal detection signals in the form of an audible beat.

The transmitter and receiver coils 40, 50; 42, 52 can be shielded from each other as they are positioned in the insulating plastic material forming the ADF cover 12 and/or the panel forming the bottom 14 of the ADF during molding of these parts and electrical conductors or cables may be subsequently attached thereto for connecting the coils to the other parts of the metal detector or detectors as is well within the skill of those in the art.

In its method aspects, the invention involves detection of the presence of foreign metal objects in a document feed path by energizing a conductive transmitter loop by supplying alternating electrical energy to the loop to generate a pulsed magnetic field proximate the feed path. Magnetic field signals reflected from metal objects in the path of said pulsed magnetic field are received in a conductive receiver loop (which may comprise the transmitter loop) and electrical signals induced in the receiver loop are then amplified and processed to produce output signals. The output signals are analyzed to discriminate among output signals produced in the receiver loop by magnetic reflections from metal objects of varying types. An alarm signal is produced when an undesired metal object in the feed path is detected.

It will also be apparent to persons skilled in the art that various changes and modifications of an obvious nature can be made from the specific embodiments described above and shown in the attached drawings and that such changes and modifications are considered to fall within the scope of the attached claims.

What is claimed is:

1. A document processing apparatus comprising:

a feeder for transporting document sheets along a feed path; and a detector for detecting the presence of foreign metal objects in said feed path, said detector comprising a source of alternating electrical energy connected to a conductive transmitter loop for generating a pulsed magnetic field proximate said feed path, a conductive receiver loop for receiving reflected magnetic field signals, means for amplifying and processing magnetically induced electrical signals in said receiver loop to produce output signals and a phase shift analyzer to discriminate among output signals produced in said receiver loop by magnetic reflections from metal objects of varying types, said detector providing an output signal when an undesired metal object in said feed path is detected.

2. The apparatus of claim 1, further comprising means for adjusting said phase shift analyzer to discriminate between metal objects containing different amounts of metal.

3. The apparatus of claim 1, wherein said transmitter loop is spaced outwardly of said receiver loop.

4. The apparatus of claim 3, wherein said transmitter loop and said receiver loop are in the same plane.

5. The apparatus of claim 4, wherein said spaced loops are located in a document support surface.

6. The apparatus of claim 4, wherein said spaced loops are located in the cover of a document support surface.

7. The apparatus of claim 1, wherein said metal detector is a VLF detector.

8. The apparatus of claim 1, wherein said metal detector is a pulse induction detector.

9. The apparatus of claim 8, wherein said pulse induction detector comprises a source of alternating electrical energy and said transmitter loop and said receiver loop comprise a common conductive transmitter/receiver loop, said transmitter/receiver loop being connected to and a receiver of electrical signals induced in said loop by reflected pulses, said receiver including a sampling circuit to monitor the duration of reflected pulses to produce said output signal.

10. The apparatus of claim 1, wherein said metal detector is a beat frequency oscillator.

11. The apparatus of claim 10, wherein said detector includes conductive transmitter and receiver coils and an oscillator for producing pulses of offset frequency in said coils to generate said output signal in the form of an audible beat.

12. The apparatus of claim 1, wherein said output signal is an operator warning signal.

13. The apparatus of claim 1, wherein said output signal is a feeder stop signal.

14. A document processing apparatus having a feeder for transporting document sheets along a feed path and a detector for detecting the presence of metal object in said feed path which may interfere with efficient document processing, said detector comprising an oscillator for producing pulses of offset frequency, said oscillator connected to a conductive transmitter/receiver loop for generating a pulsed magnetic field proximate said feed path, a receiver of electrical energy connected to said loop for amplifying and generating an output signal in the form of an audible beat when an undesired metal object in said feed path is detected.

15. The apparatus of claim 14, wherein said transmitter/receiver loop is located in a document support surface.

16. The apparatus of claim 15, wherein said transmitter/receiver loop is located in the cover of a document support surface.

17. The apparatus of claim 14, wherein said output signal is an operator warning signal.

18. The apparatus of claim 14, wherein said output signal is a feeder stop signal.

19. A method of detecting the presence of foreign metal objects in a document feed path comprising energizing a conductive transmitter loop by supplying alternating electrical energy to said loop to generate a pulsed magnetic field proximate said feed path, receiving magnetic field signals reflected from metal objects in the path of said pulsed magnetic field in a conductive receiver loop, amplifying and processing electrical signals induced in said receiver loop by reflected magnetic field signals to produce output signals, analyzing said output signals to discriminate among output signals produced in said receiver loop by magnetic reflections from metal objects of varying types, and producing an alarm signal when an undesired metal object in said feed path is detected.

20. The method of claim 19, wherein said analysis of said output signals comprises detecting shifts in phase of said output signals.

21. The method of claim 19 comprising positioning said transmitter loop outwardly of said receiver loop.

22. The method of claim 21 comprising positioning said transmitter loop and said receiver loop in the same plane.

23. The method of claim 19 comprising supplying pulsed energy to a common conductive transmitter/receiver loop, sampling and monitoring the duration of reflected pulses to produce said alarm signal.

24. The method of claim 19, comprising producing pulses of offset frequency in said coils to generate said alarm signal in the form of an audible beat.

* * * * *